US007915211B2

(12) United States Patent
Zeller et al.

(10) Patent No.: US 7,915,211 B2
(45) Date of Patent: Mar. 29, 2011

(54) SOLID CLEANERS FOR HEATED FOOD PREPARATION SURFACES

(75) Inventors: Lowell C. Zeller, Woodbury, MN (US); Duane D. Fansler, Dresser, WI (US); Gerald R. Hofmann, Oakdale, MN (US); Adriana Paiva, Woodbury, MN (US); Smarajit Mitra, West St. Paul, MN (US); Terry R. Hobbs, St. Paul, MN (US); Naiyong Jing, Woodbury, MN (US); Augustine C. Liu, Bloomington, MN (US); Mitchell T. Johnson, Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 414 days.

(21) Appl. No.: 11/816,315

(22) PCT Filed: Mar. 14, 2006

(86) PCT No.: PCT/US2006/009221

§ 371 (c)(1),
(2), (4) Date: Jun. 13, 2008

(87) PCT Pub. No.: WO2006/101866

PCT Pub. Date: Sep. 28, 2006

(65) Prior Publication Data

US 2009/0145458 A1 Jun. 11, 2009

Related U.S. Application Data

(60) Provisional application No. 60/663,067, filed on Mar. 18, 2005, provisional application No. 60/733,124, filed on Nov. 3, 2005.

(51) Int. Cl.
*C11D 7/60* (2006.01)

(52) U.S. Cl. ..... 510/195; 510/365; 510/395

(58) Field of Classification Search ..... 510/195, 510/365, 395

See application file for complete search history.

(56) References Cited

U.S. PATENT DOCUMENTS

| | | | | |
|---|---|---|---|---|
| 3,766,097 | A | 10/1973 | Rosmarin | |
| 3,953,353 | A | 4/1976 | Barrett, Jr. et al. | |
| 5,496,493 | A | 3/1996 | Cox et al. | |
| 5,593,662 | A * | 1/1997 | Deckner et al. | 424/64 |
| 5,756,438 | A | 5/1998 | Rau et al. | |
| 5,945,389 | A | 8/1999 | Richard et al. | |
| 6,132,736 | A * | 10/2000 | Mellul et al. | 424/401 |
| 6,153,204 | A * | 11/2000 | Fanger et al. | 424/401 |
| 6,258,765 | B1 * | 7/2001 | Wei et al. | 510/224 |
| 6,387,870 | B1 * | 5/2002 | Klaers et al. | 510/445 |
| 2004/0072488 | A1 | 4/2004 | Childs et al. | |

FOREIGN PATENT DOCUMENTS

| | | |
|---|---|---|
| DE | 43 44 155 | 6/1995 |
| DE | 199 48 667 | 4/2001 |
| GB | 592206 | 9/1947 |
| WO | WO 92/07931 | 5/1992 |
| WO | WO 94/07991 | 4/1994 |

(Continued)

*Primary Examiner* — Gregory E Webb
(74) *Attorney, Agent, or Firm* — Jeffrey M. Olofson

(57) ABSTRACT

A solid cleaner for heated surfaces is disclosed. The solid cleaner includes a solidifying agent including wax, and a cleaning agent. The solid cleaner is solid at room temperature and liquid at an elevated temperature. Methods of cleaning a heated surface and cleaning articles are also disclosed.

20 Claims, 1 Drawing Sheet

FOREIGN PATENT DOCUMENTS

| | | |
|---|---|---|
| WO | WO 95/13357 | 5/1995 |
| WO | WO 97/40131 | 10/1997 |
| WO | WO 97/43396 | 11/1997 |
| WO | WO 98/24871 | 6/1998 |
| WO | WO 2004053049 | 6/2004 |
| WO | WO 2004/062702 | 7/2004 |

* cited by examiner

SOLID CLEANERS FOR HEATED FOOD PREPARATION SURFACES

CROSS REFERENCE TO RELATED APPLICATIONS

This application is a national stage filing under 35 U.S.C. 371 of PCT/US2006/009221, filed Mar. 14, 2006, which claims priority to 60/663,067, filed Mar. 18, 2005 and 60/733,124, filed Nov. 3, 2005, the disclosure of which is incorporated by reference in its/their entirety herein.

BACKGROUND

The present disclosure is directed generally to solid cleaners and the use of such on heated food preparation surfaces, and more particularly to heated griddle and oven surfaces.

Griddles or ovens are heated cooking flat or "clam shell" surfaces made of stainless steel, nickel plated, polished steel, or cast iron, for example. Griddles or ovens are heated either by electricity or gas to elevated temperatures such as, for example 275 degrees Celsius. Food prepared on or adjacent to these heated surfaces leave reside or "soil" on these heated surfaces. Thus, these surfaces must be cleaned periodically such as, for example, at least once per day.

Conventional cleaning systems fall into three categories. One technology uses abrasive cleaners. These systems require multiple washing and rinsing steps to remove residue from the food preparation surface. Another technology involves shocking a heated food preparation surface with cold water to cause contraction of the food preparation surface and release of baked-on food soils. This method is considered too detrimental to the food preparation equipment and can reduce the life of the food preparation equipment. Another technology uses liquid cleaning solutions that are applied to the heated food preparation surface and mechanically scrubbed. Liquid cleaning solutions are often difficult to apply evenly and consistently and portion control of the liquid cleaning solutions can be challenging.

SUMMARY

Generally, the present disclosure relates to solid cleaners and the use of such on heated surfaces. In particular, the disclosure is based around a solid cleaner that melts on a heated food preparation surface.

The present disclosure provides a solid cleaner for heated surfaces. The solid cleaner includes a solidifying agent including wax, and a cleaning agent. The solid cleaner is solid at room temperature and liquid at an elevated temperature.

One embodiment of the present disclosure provides a method of cleaning a heated surface. The method includes the steps of contacting a heated surface including cooking residue with a solid cleaner, melting the solid cleaner on the heated surface, contacting the cooking residue with the melted solid cleaner, and removing at least a portion of the cooking residue from the heated surface.

In another embodiment a cleaning article is disclosed. The cleaning article includes a substrate, and a solid cleaner disposed on or within the substrate. The solid cleaner includes a solidifying agent including wax, and a cleaning agent. The solid cleaner is solid at room temperature and liquid at an elevated temperature.

BRIEF DESCRIPTION OF THE DRAWINGS

The disclosure may be more completely understood in consideration of the following detailed description of various embodiments of the disclosure in connection with the accompanying drawings, in which.

Figure 1:
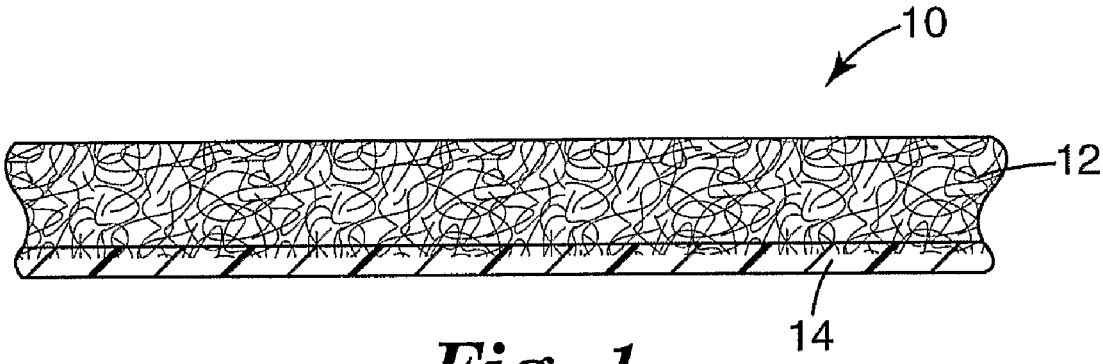
FIG. 1 is a schematic side-elevation view of an illustrative cleaning article.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

The following description should be read with reference to the drawings, in which like elements in different drawings are numbered in like fashion. The drawings, which are not necessarily to scale, depict selected illustrative embodiments and are not intended to limit the scope of the disclosure. Although examples of construction, dimensions, and materials are illustrated for the various elements, those skilled in the art will recognize that many of the examples provided have suitable alternatives that may be utilized.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

Weight percent, percent by weight, % by weight, % wt, and the like are synonyms that refer to the concentration of a substance as the weight of that substance divided by the weight of the composition and multiplied by 100.

The recitation of numerical ranges by endpoints includes all numbers subsumed within that range (e.g. 1 to 5 includes 1, 1.5, 2, 2.75, 3, 3.80, 4, and 5) and any range within that range.

As used in this specification and the appended claims, the singular forms "a", "an", and "the" encompass embodiments having plural referents, unless the content clearly dictates otherwise. For example, reference to a composition containing "a cleaning agent" encompasses embodiments having one, two or more cleaning agents. As used in this specification and the appended claims, the term "or" is generally employed in its sense including "and/or" unless the content clearly dictates otherwise.

The terms "insoluble" or "substantially insoluble" refers to a material that does not dissolve or disperse in water. In some embodiments, a material that is less than 10% soluble in water is a material that is insoluble or substantially insoluble in water. In other embodiments, a material that is less than 5% soluble in water is a material that is insoluble or substantially insoluble in water. In still other embodiments, a material that is less than 1% soluble in water is a material that is insoluble or substantially insoluble in water.

The present disclosure is believed to be applicable generally to solid cleaners and the use of such solid cleaners on heated surfaces. Specifically, the disclosure is based around a solid cleaner that melts on a heated food preparation surface such as, for example, a grill surface, a griddle surface, or an oven surface. The heated surface can be formed of any material including, for example, metal, ceramic, glass, and/or plastic. These examples, and the examples discussed below, provide an appreciation of the applicability of the disclosed cleaning systems, but should not be interpreted in a limiting sense.

A solid cleaner for heated surfaces is disclosed that includes one or more solidifying agents and one or more cleaning agents. The solid cleaner is solid at room temperature (e.g., 24 degrees Celsius) and a liquid at an elevated temperature. The elevated temperature can be any useful temperature at which the solid cleaner begins to melt (e.g., melting point.) The solid cleaner can have any useful melting point. In some embodiments, the solid cleaner has a melting point in a range from 35 to 150 degrees Celsius or from 35 to 100 degrees Celsius, or from 45 to 90 degrees Celsius, as desired. Solid cleaners that melt on heated surfaces provide one or more of the following advantages over liquid cleaners: increased dwell time; decreased cleaner evaporation; and/or the ability to be used on vertical heated surfaces. In many embodiments, the solid cleaners have an accelerated cleaning action at elevated temperatures (e.g., above 100 degrees centrigrade.) In many embodiments, the solid cleaner is generally recognized as safe (GRAS) for food contact.

The solid cleaner can be any defined size or shape, In some embodiments, the solid cleaner has a cube shape, a cuboid shape, a pyramid shape, a cylinder shape, a cone shape, a sphere shape, or portions thereof. In some embodiments, the solid cleaner has a weight from 1 gram to 10 kilograms, or from 1 to 1000 grams, or from 5 to 500 grams, or from 10 to 200 grams. In other embodiments, the solid cleaner is a powder, pellet, flake, tablet, bar, and the like. The solid cleaner can be combined, or used in conjunction with other cleaning articles such as, for example a non-woven scouring pad, as described below, an abrasive coated woven web substrate griddle screen such as, for example SCOTCH-BRITE™ griddle screen number 200, or a pumice block, as desired.

The solid cleaner includes one or more solidifying agents that can assist in forming the solid cleaner. The term "solid" can be defined as a material having a definite volume and configuration independent of its container. Any useful solidifying agent can be used to form the solid cleaner. Any useful amount of solidifying agent can be used to assist in solidifying the solid cleaner. In many embodiments, the solidifying agent is inert or does not assist in the cleaning action of the solid cleaner. In many embodiments, the solidifying agent is generally recognized as safe (GRAS) for food contact. In certain embodiments, the solid cleaner does not need to be rinsed off of the cleaned surface, implying that it is a "no-rinse" cleaner and GRAS for food contact.

In many embodiments, the solidifying agent includes one or more waxes. The wax can be a natural wax or synthetic wax. In some embodiments where the solid cleaner includes wax, the solid cleaner is substantially insoluble in water up to at least 35 degrees Celsius. In some embodiments, the solidifying agent includes a natural wax such as, for example, a beeswax, a candelilla wax, a carnauba wax, a rice bran wax, a lemon peel wax, a soy wax, an orange peel wax, or mixtures thereof. In other embodiments, the solidifying agent includes a synthetic wax such as, for example, Baker-Hugnes (Petrolite) makes Bareco High Melt Microcrystalline waxes (melting point 82 to 93 degrees centigrade), Bareco Flexible Microcrystalline waxes (melting point 65 to 82 degrees centigrade), Starwax™, Victory™, Ultraflex™ and Be Square™ waxes, among others. EMS-Griltech (Switzerland) also makes synthetic low melting polymers such as copolyamide, and copolyesters. Synthetic waxes can also include PEG waxes that are solids such as PEG 1000 NF/FCC, fatty alcohols such as cetyl alcohol, and fatty esters such as propylene glycol monostearate, glycerol monolaurate, and sorbitan esters.

In some embodiments, the solidifying agent includes an emulsifying wax. The emulsifying wax can replace a portion of the one or more waxes, as desired. Emulsifying wax can include, for example, a blend of fatty acids (stearic, palmitic, oleic, capric, caprylic, myristic, and lauric), fatty alcohols (stearyl, cetyl) and/or fatty esters (polysorbates or TWEEN), and the like. In some embodiments, the emulsifying wax is a fatty alcohol such as, for example, stearic alcohol, cetyl alcohol, or mixtures thereof. One example of an emulsifying wax is Emulsifying Wax NF (cas# 67762-27-0; 9005-67-8) and is a blend of cetearyl alcohol, polysorbate 60, PEG-150 stearate & steareth-20. If present, the emulsifying wax to other wax weight ratio can be from 1:1 to 1:5, or from 3:1 to 1:3, or from 2:1 to 1:2 as desired.

Wax can be included in the solid cleaner in any useful amount. In many embodiments, a solidifying amount of wax is included in the solid cleaner. In some embodiments, wax is present in the solid cleaner in a range from 10 to 80 wt %, or from 25 to 75 wt %, or from 30 to 50 wt %.

In some embodiments, the solidifying agent includes a one or more solid polyols. The term "polyol" refers to any organic molecule comprising at least two free hydroxyl groups. Polyols include polyoxyethylene derivatives such as, for example, glycol (diols), triols and monoalcohols, ester, or ethers thereof. Examples of polyols include solids glycols such as, for example, polyethylene glycols (PEG) under the trade name Carbowax series available from Dow Chemical, Midland Mich., polypropylene glycols (PPG) available from Dow Chemical, Midland, Mich., sorbitol and sugars, and solid polyesters such as, for example, poly(ε-caprolactone) under the trade name Tone series from Dow Chemical, Midland Mich., glycerol esters such as, for example, fatty acid mono ester. Fatty acid monoesters include but are not limited to propylene glycol monostearate, glycerol monolaurate, and glycerol monostearate. These esters are GRAS or approved as direct food additives.

Polyol can be included in the solid cleaner in any useful amount. In many embodiments, a solidifying amount of polyol is included in the solid cleaner. In some embodiments, polyol is present in the solid cleaner in a range from 10 to 80 wt %, or from 25 to 75 wt %, or from 30 to 50 wt %.

The solid cleaner includes one or more cleaning agents that can assist in the cleaning action of the solid cleaner. The cleaning agent can be any useful cleaning agent. The cleaning agent can be present in the solid cleaner in any useful amount. In many embodiments, the cleaning agents are generally recognized as safe (GRAS) for food contact.

Cleaning agents include, for example, surfactants, and pH modifiers. In many embodiments, a cleaning amount of cleaning agent is included in the solid cleaner. In many embodiments, the cleaning agent is capable of removing at least a portion of the soil or residue on the heating surface without mechanical scrubbing action. In illustrative embodiments, the cleaning agent is present in the solid cleaner in range from 1 to 90 wt %, or from 1 to 50 wt %, or from 5 to 30 wt %.

In some embodiments, the cleaning agent includes one or more pH modifiers. These pH modifiers include alkaline compounds such as, inorganic alkaline compounds including for example, hydroxides, silicates, phosphates, and carbonates; and organic alkaline compounds including for example, amines. In other embodiments, the pH modifier is an acidic compound such as, for example, citric acid and the like.

In some embodiments, the cleaning agent is a carbonate salt such as, for example, calcium carbonate, potassium carbonate, or sodium carbonate. In some embodiments, the carbonate salt includes potassium carbonate and sodium carbonate that is dissolved in water, forming carbonate ions. In other embodiments, the carbonate salt includes a bicarbonate salt such as, for example, sodium bicarbonate. In further embodiments, the cleaning agent includes a silicate salt such as, for example, sodium metasilicate.

The pH modifiers can be included in the solid cleaner in any useful amount. In many embodiments, the pH modifier is present in the solid cleaner in range from 0.1 to 80 wt %, or from 1 to 50 wt %, or from 5 to 30 wt %. In many embodiments, the solid cleaner has a pH in a range from 7 to 13.

In some embodiments, the cleaning agent includes one or more surfactants. These surfactants include, for example, natural surfactants, anionic surfactants, nonionic surfactants, and amphoteric surfactants. Natural surfactants include, but are not limited to, coconut-based soap solutions. Anionic surfactants include, but are not limited to, dodecyl benzene sulfonic acid and its salts, alkyl ether sulfates and salts thereof, olefin sulfonates, phosphate esters, soaps, sulfosuccinates, and alkylaryl sulfonates. Amphoteric surfactants include, but are not limited to, imidazoline derivatives, betaines, and amine oxides. These surfactants can be included in the solid cleaner in any useful amount. In many embodiments, the surfactant is present in the solid cleaner in range from 5 to 80 wt %, or from 5 to 50 wt %, or from 5 to 30 wt %. In many embodiments, the surfactant is food grade surfactant, approved for use as a direct food additive. Often, food grade surfactants are used so that the cleaning surface does not need to be rinsed.

In some embodiments, the cleaning agent includes carbonate salts such as, for example, sodium and/or potassium carbonate with an amount of surfactant less than 5 wt %, or less than 3 wt %, or less than 1 wt % based on the solid cleaner weight. In some embodiments, the cleaning agent includes carbonate salts such as, for example, sodium and/or potassium carbonate with an amount of a natural surfactant less than 5 wt %, or less than 3 wt %, or less than 1 wt % based on the solid cleaner weight.

The solid cleaner may optionally include one or more carriers. The carrier can be any amount of useful carrier that can provide solubility for any pH modifier and/or provide good food soil pick up and/or have sufficiently low viscosity upon heating and/or allows the solid cleaner to retain its shape at room temperature. In many embodiments, the carrier is generally recognized as safe (GRAS) for food contact. Carriers include, for example, water, glycerin, triethylene glycol, and diethylene glycol. In some embodiments, the carrier is present in the solid cleaner in range from 0 to 80 wt %, or from 1 to 60 wt %, or from 25 to 50 wt %.

In some embodiments, the carrier includes glycerin or glycerol. In certain embodiments, glycerin or glycerol can also act as a solubilizer of soils to be cleaned from the heated surfaces. When present, glycerin can make up from 1 to 80 wt %, or from 1 to 50 wt %, or from 5 to 40 wt %, or from 10 to 30 wt %. In some embodiments, the carrier includes water. When present, water can make up from 1 to 80 wt %, or from 1 to 50 wt %, or from 5 to 40 wt %, or from 10 to 30 wt %. In further embodiments, the carrier includes water and glycerin. When present, water and glycerin can make up from 1 to 80 wt %, or from 1 to 50 wt %, or from 5 to 40 wt %, or from 10 to 30 wt %.

Thickeners can be optionally included in the solid cleaner, as desired. In many embodiments, thickeners can replace a portion of the solidifying agent, as desired. Thickeners can include, for example, xanthan gum, guar gum, polyols, alginic acid, sodium alginate, propylene glycol, methyl cellulose, polymer gels, clay, gelatin/clay mixtures, gelatin/oxide nanocomposite gels, smectite clay, montmorillonite clay, fillers e.g. $CaCO_3$ and mixtures of therein. If present, thickeners can make up from 0.1 to 25 wt %, or from 0.5 to 10 wt %.

Abrasive material can be optionally included in the solid cleaner, as desired. In many embodiments, the abrasive materials incorporated into the solid cleaning composition can assist in the mechanical scrubbing action and can be used alone or in addition to an abrasive pad described herein. Abrasive materials include, for example, inorganic abrasive particles, organic based particles, sol gel particles or combinations thereof. Further examples of suitable abrasive particles are described in WO 97/49326.

Additives can be optionally includes in the solid cleaner, as desired. Additives can include, for example, builders, corrosion inhibitors (e.g., sodium benzoate), sequestering agents (EDTA), dyes, preservatives, and fragrances. In many embodiments, the additives are generally recognized as safe (GRAS) for food contact or approved for use as a direct food additive.

FIG. 1 is a schematic side-elevation view of an illustrative cleaning article 10. A solid cleaner layer 14 is disposed on a cleaning substrate 12. The illustrated embodiment of the cleaning substrate 12 is a non-woven substrate, described below; however the cleaning substrate 12 may be a woven substrate such as a griddle screen or cloth material. In other embodiments, the substrate is a foam material or a sponge material. In some embodiments, the solid cleaner layer 14 can be disposed on and within (i.e., impregnated into) the cleaning substrate 12.

Figure 2:
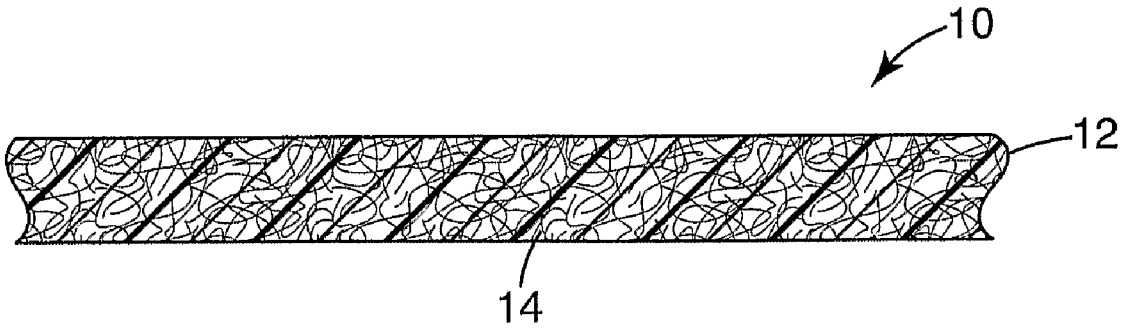
FIG. 2 is a schematic side-elevation view of another illustrative cleaning article.

FIG. 2 is a schematic side-elevation view of another illustrative cleaning article 20. A solid cleaner layer 14 is disposed within a cleaning substrate 12. The illustrated embodiment of the cleaning substrate 12 is a non-woven substrate, described below.

In some embodiments, a non-woven substrate can be combined with the solid cleaners disclosed herein. Non-woven substrates are suited for scouring heated surfaces and can assist in physical removal of food soils at least partially removed or softened by the solid cleaners disclosed herein. In many embodiments, non-woven substrates include non-woven webs of fibers.

In general, non-woven webs of fibers may be made of an air-laid, carded, stitch-bonded, thermobonded and/or resin-bonded construction of fibers, all as known by those skilled in the art. Fibers suitable for use in non-woven substrate materials include natural and synthetic fibers, and mixtures thereof. Synthetic fibers are preferred including those made of polyester (e.g., polyethylene terephthalate), nylon (e.g.; hexamethylene adipamide, polycaprolactam), polypropylene, acrylic (formed from a polymer of acrylonitrile), rayon, cellulose acetate, and so forth. Suitable natural fibers include those of cotton, wool, jute, and hemp. The fiber material can be a homogenous fiber or a composite fiber, such as bicomponent fiber (e.g., a co-spun sheath-core fiber). Non-woven substrate materials may also include different fibers in different portions. In some thermobonded non-woven substrate embodiments, the substrate includes melt bondable fibers where the fibers are bonded to one another by melted portions of the fibers.

In some embodiments, the non-woven substrate material is an open, low density, three-dimensional, non-woven web of fibers, the fibers bonded to one another at points of mutual contact, referred to in the following as a "lofty, nonwoven web material". In some embodiments, the fibers are thermobonded and/or resin-bonded (i.e. with a hardened resin, e.g. a prebond resin) to one another at points of mutual contact. In other embodiments, the fibers are resin-bonded to one another at points of mutual contact. Because the fibers of the web are bonded together at points of mutual contact, e.g. where they intersect and contact one another, a three-dimensional web structure of fibers is formed. The many interstices between adjacent fibers remain substantially unfilled, for example by resin, and thus an open web structure of low density having a network of many relatively large intercommunicated voids is provided. The term "open, low density" non-woven web of fibers is understood to refer to a non-woven web of fibers that exhibits a void volume (i.e. percentage of total volume of voids to total volume occupied by the non-woven web structure) of at least 75%, or at least 80%, or at least 85%, or in the range of from 85% to at least 95%. Such a lofty, non-woven web material is described in U.S. Pat. No. 2,958,593, which is incorporated by reference herein.

Another example of a lofty, non-woven web material is described by U.S. Pat. Nos. 2,958,593, and 4,227,350, which are incorporated by reference herein. These patents disclose a lofty, non-woven web formed from a continuous extrusion of nylon coil material having a diameter in a range from 100 micrometers to 3 mm. Inorganic and/or organic abrasive materials can be optionally included on these non-woven webs.

In some resin-bonded, lofty non-woven web material embodiments, the resin includes a coatable resinous adhesive such as a thermosetting water based phenolic resin, for example. Polyurethane resins may also be employed as well as other resins. Those skilled in the art will appreciate that the selection and amount of resin actually applied can depend on any of a variety of factors including, for example, fiber weight, fiber density, fiber type as well as the contemplated end use. Suitable synthetic fibers for production of such a web include those capable of withstanding the temperatures at which selected resins or adhesive binders are cured without deterioration.

In some lofty, non-woven web material embodiments, suitable fibers are between 20 and 110 mm, or between 40 and 65 mm, in length and have a fineness or linear density ranging from 1.5 to 500 denier, or from 1.5 to 100 denier. Fibers of mixed denier can also be used, as desired. In one embodiment, the non-woven substrate includes polyester or nylon fibers having linear densities within the range from 5 to 65 denier.

Lofty, non-woven web materials may be readily formed, e.g. air laid, for example, on a "Rando Webber" machine (commercially available from Rando Machine Company, New York) or may be formed by other conventional processes such as by carding or by continuous extrusion. Useful lofty, non-woven substrate materials have a fiber weight per unit area of at least 25 g/m$^2$, or at least 50 g/m$^2$, or between 50 and 1000 g/m$^2$, or between 75 and 500 g/m$^2$. Lesser amounts of fiber within the lofty, non-woven substrate materials will provide webs, which may be suitable in some applications.

The foregoing fiber weights will provide a useful non-woven substrate having a thickness from 5 to 200 mm, or between 6 to 75 mm, or between 10 and 30 mm. For phenolic prebond resins applied to a lofty, non-woven substrate having a fiber weight within the above ranges, the prebond resin is applied to the web or substrate in a relatively light coating, providing a dry add-on weight within the broad range from 50 to 500 g/m$^2$.

The foregoing lofty, non-woven substrate materials are effective for most scouring applications. For more intensive scouring applications, the lofty, non-woven substrate materials may be provided with abrasive particles dispersed and adhered there within. The abrasive particles can be adhered to the surfaces of the fibers in the lofty, non-woven substrate material. In many embodiments, the abrasive particles may include inorganic abrasive particles, organic based particles, sol gel particles or combinations thereof, all as known in the art. Examples of suitable abrasive particles as well as methods and binders for adhering abrasive particles onto the surfaces of the fibers are for example described in WO 97/49326.

In some embodiments, abrasive particles are adhered to the fibers of the non-woven substrate by a hardened organic resin binder such as, for example, a heat cured product of a thermosetting coatable resinous adhesive applied to the fibers of the non-woven substrate as a "binder precursor". As used herein, "binder precursor" refers to a coatable resinous adhesive material applied to the fibers of the non-woven substrate to secure abrasive particles thereto. "Binder" refers to the layer of hardened resin over the fibers of the nonwoven web formed by hardening the binder precursor. In some embodiments, the organic resins suitable for use as a binder precursor in the non-woven substrate are formed from an organic binder precursor in a flowable state. During the manufacture of the non-woven substrate, the binder precursor can be converted to a hardened binder or make coat. In some embodiments, the binder is in a solid, non-flowable state. In some embodiments, the binder is formed from a thermoplastic material. In other embodiments, the binder is formed from a material that is capable of being cross-linked. In some embodiments, a mixture of a thermoplastic binder and a cross-linked binder is also useful.

During the process to make the web or substrate, the binder precursor can be mixed with the foregoing abrasive particles to form an adhesive/abrasive slurry that may be applied to the fibers of the non-woven by any of a variety of known methods such as roll coating, knife coating, spray coating, and the like. The thus applied binder precursor is then exposed to the appropriate conditions to solidify the binder. For cross-linkable binder precursors, the binder precursor can be exposed to the appropriate energy source to initiate polymerization or curing and to form the hardened binder.

In some embodiments, the organic binder precursor is an organic material that is capable of being cross-linked. The binder precursors can be either a condensation curable resin or an addition polymerizable resin, among others. The addition polymerizable resins can be ethylenically unsaturated monomers and/or oligomers. Examples of useable cross-linkable materials include phenolic resins, bis-maleimide binders, vinyl ether resins, aminoplast resins having pendant alpha,beta-unsaturated carbonyl groups, urethane resins, epoxy resins, acrylate resins, acrylated isocyanurate resins, urea-formaldehyde resins, melamine formaldehyde resins, phenyl formaldehyde, styrene butadiene resins, isocyanurate resins, acrylated urethane resins, acrylated epoxy resins, or mixtures thereof. The binder precursor suitable for use is a coatable, hardenable adhesive binder and may comprise one or more thermoplastic or, thermosetting resinous adhesives. Resinous adhesives suitable for use in the present invention include phenolic resins, aminoplast resins having pendant alpha,beta-unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, fluorene-modified epoxy resins, and combinations thereof. Examples of these resins can be found in WO 97/49326. Catalysts and/or curing agents may be added to the binder precursor to initiate and/or accelerate the polymerization process. In many embodiments the substrate can withstand temperatures up to at least 200 degrees Celsius, (e.g., food preparation operating temperature.)

Commercially available non-woven substrate or web materials are available under the trade designation "Scotch-Brite™ General Purpose Scour Pad No. 96," "Scotch-Brite™ Heavy Duty Griddle Cleaner No. 82 (non-woven glass cloth)," "Scotch-Brite™ All Purpose Scour Pad No. 9488R," "Scotch-Brite™ Heavy Duty Scour Pad No. 86," all available from 3M Co. In other embodiments, the substrate is a Scotch-Brite™ Griddle Screen No. 68, a Scotch-Brite™ Griddle Screen No. 200, steel-wool, pumice block, foamed glass bricks, and the like.

EXAMPLES

All chemicals were used as commercially available.

| | |
|---|---|
| Quick Clean | Scotch-Brite ™ Quick Clean Griddle Liquid, No. 700, 3M Co., St. Paul, MN |
| FAME | Fatty Acid Mono Ester (Lauricidin ™), Med-Chem. Laboratories, Galena, IL |
| PEG | Poly(ethylene glycol) (1000 Da, 4600 Da, or 8000 Da), Aldrich, Milwaukee, WI. |
| Potassium Carbonate $K_2CO_3$ (anhydrous) | Ashta Chemicals, Ashtabula, OH. |
| Sodium Carbonate $Na_2CO_3$ (monohydrate) | J. T. Baker, Phillipsburg, NJ. |
| Stock Solution #1 | 10 g Potassium Carbonate/4 g Sodium Carbonate/20 g DI Water |
| Stock Solution #2 | 12 g Potassium Carbonate/6 g Sodium Carbonate/20 g DI Water |
| Stock Solution #3 | 10 g Potassium Carbonate/4 g Sodium Carbonate/15 g DI Water |
| Stock Solution #4 | 10 g Potassium Carbonate/4 g Sodium Carbonate/14 g DI Water |
| Glycerin | Merck KGaA, Darmstadt Germany |
| Tone Polyol 210 | Melting Point Range: 35° to 45° C., Dow/Union Carbide, Midland, MI |
| Tone Polyol 230 | Melting Point Range: 40° to 50° C., Dow/Union Carbide, Midland, MI |
| Tone Polyol 240 | Melting Point Range: 45° to 55° C., Dow/Union Carbide, Midland, MI |
| Tone Polyol 260 | Melting Point Range: 50° to 60° C., Dow/Union Carbide, Midland, MI |
| #46 Pad | Scotch-Brite ™ Griddle Polishing Pad No. 46, 3M Co., St. Paul, MN |
| #9488R Pad | Scotch-Brite ™ All Purpose Scouring Pad No. 9488R, 3M Co., St. Paul, MN |
| SPAN 40 | Sorbitan Monopalmitate Surfactant, Aldrich, Milwaukee, WI |
| SPAN 65 | Sorbitan Tristearate Surfactant, Imperial Chemical Industries (ICI), London, UK |
| Brij 35 | Dodecylpoly(ethylene glycol) ether surfactant, Uniquema (ICI) London, UK |
| Pluracare L44 NF | Block copolymer of poly(ethylene glycol) and poly(propylene glycol), BASF, Lundwigshafen, DE |
| BioSoft D-40 | Sodium Dodecylbenzene Sulphonate Surfactant, Stepan Company, Northfield, IL |
| EDTA | Ethylene Diamine Tetra Acetate - Sequesterant Eastman Kodak Co., Kingsport, TN |
| Xanthan Gum | R. T. Vanderbilt Company, Inc. Norwalk, CT. |
| Candelilla wax | Strahl & Pitsch, Inc., West Babylon, CT. |
| Sodium Metasilicate | J. T. Baker, Phillipsburg, NJ. |
| Sodium Bicarbonate | Mallinckrodt BaKER, Inc., Paris, KY |
| Melamine formaldehyde particles | Particle 40/100 mesh. Maxi-Blast, Inc., South Bend, IN. |
| Pumice 0 | Charles B. Chrystal Co., Inc. New York, NY |
| Pumice FF | Charles B. Chrystal Co., Inc. New York, NY |
| Emulsifying wax NF | Strahl & Pitsch, Inc., West Babylon, CT. |
| Cetyl Alcohol | TCI Mark |
| Stearyl Alcohol | Alfol 18 - Sasol North America Inc., Weslake, Louisiana. |

Test Methods for Cleaning the Griddle

Burnt Oil Test Method

1. Turn all three burners on the flat griddle (Star Mftg. Model 536-76A. Smithville Tenn.) to 450° F. (232° C.).
2. Measure about 40 mL of commercially available soybean oil (e.g., Crisco) and pour on the griddle.
3. Spread out oil with a 3M Green Scotch-Brite™ General Purpose Scour Pad No. 96 until even over entire surface of griddle.
4. Let griddle heat oil for 45 minutes. Oil should be dark brown and of fairly uniform color across the entire griddle.
5. Decrease the temperature of the griddle to 300-350° F. (150-175° C.).
6. Measure the temperature of the griddle with the IR thermometer (Dickson, Chicago, Ill.) and record it. It should be between 300-350° F. (150-175° C.).
7. Apply test cleaning composition on desired amount of griddle. 100 grams of test cleaning composition for the entire griddle.
8. Apply test cleaner over griddle surface with Scotch-Brite™ Griddle Polishing Pad No. 46 on pad holder and record the amount of time for the entire product to melt.
9. Turn off burner under section of griddle you are testing.
10. Immediately begin scrubbing using #46 pad and record amount of time necessary for acceptable level of cleanliness.

11. Scrape griddle surface with squeegee to move melted wax into grease trap.
12. Repeat cleaning over other surfaces of griddle with other test cleaners.
13. Using a wet paper towel on the pad holder, rinse surface and edges of griddle.
14. Apply a small amount of oil to surface of griddle and spread with Scotch-Brite™ General Purpose Scour Pad No. 96 to season the surface.
15. Wipe up any excess oil with a paper towel Ground Beef Test Method 1. Turn all three burners to 325° F. (160° C.).
2. Weigh 2.5 lbs (1.1 Kg) of ground beef for the entire griddle
3. Cook the beef until dark brown, moving the ground beef around the griddle to make it evenly distributed.
4. Remove the beef from the griddle with the flat cooking utensil taking off as much beef as possible.
5. Leave the food soil cooking for an extra 60 minutes
6. Measure the temperature of the griddle and record it. It should be between 300-350° F. (150-175° C.).
7. Apply test cleaner over desired amount of griddle. 100 g to 120 g of cleaning composition for the entire griddle.
8. Spread test cleaner over griddle surface with an appropriate pad (either 3M #46 Griddle Polishing Pad or 3M #9488R All Purpose Pad) on pad holder and record the amount of time for the entire product to melt.
9. Turn off burner under section of griddle you are testing.
10. Immediately begin scrubbing using the No. 46 pad and record amount of time necessary for acceptable level of cleanliness.
11. Scrape griddle surface with squeegee
12. Repeat cleaning over the entire surfaces of griddle with other test cleaners.
13. Using a wet paper towel on the pad holder, rinse surface and edges of griddle.
14. Wash out drip tray of any remaining food soil.
15. Apply a small amount of oil to surface of griddle and spread with Scotch-Brite™ General Purpose Scour Pad No. 96 to season to surface.
16. Wipe up any excess oil with a paper towel.

Preparation of the Cleaning Compositions

Stock solutions were made by dissolving the salts indicated below in de-ionized water at low heat. The solution was stirred until no more solid salts were present.

The stock solutions and glycerin (Procter & Gamble, Cincinnati, Ohio) were added to a beaker and placed on a hot plate/stirrer. The solution was heated to about 80° C. while gently mixing. The solidifying agent (wax or polyol) was added to the stock solution/glycerin mix and heated while stirring until the solidifying agent was completely melted. The formulation was taken off the heat once it was well mixed and homogenous.

Tablets and impregnated pads were made by either pouring into the molds to form tablets or pads. Tablets were made by allowing the melted formulations to cool down to room temperature in an aluminum mold of 2"×2"×1" (W×L×H). Tablets of 60 g each were made with this mold. Impregnated pads (#46) were also made by pouring the melted formulation on a mold of 4"×5"×1" (W×L×H) at about 80° C., allowing it to cool down to about 60° C. and then placing the pad onto the mold and applying a little pressure to force the pad into the solidified cleaner. The pads were allowed to cool to room temperature.

Formulations were also made of the following waxes:

Rice bran wax (Koster Keunen, Inc., Watertown, Conn., USA)

Lemon peel Wax (Koster Keunen, Inc., Watertown, Conn., USA)

Soy wax flakes (Koster Keunen, Inc., Watertown, Conn., USA)

Deodorized orange peel wax (Koster Keunen, Inc., Watertown, Conn., USA)

Beeswax (Strahl & Pitsch, Inc., West Babylon, N.J., USA)

Candelilla wax (Strahl & Pitsch, Inc., West Babylon, N.J., USA)

Carnauba wax (Strahl & Pitsch, Inc., West Babylon, N.J., USA)

Formulation 1

A solid cleaner was made by combining 34 g of stock solution #1 with 22 g of glycerin and 44 g of beeswax.

Formulation 2

A solid cleaner was made by combining 34 g of stock solution #1 with 22 g of glycerin and 44 g of carnauba wax.

Formulation 3

A solid cleaner was made by combining 34 g of stock solution #1 with 22 g of glycerin and 44 g of candelilla wax.

Formulation 4

A solid cleaner was made by combining 34 g of stock solution #1 with 33 g of glycerin and 33 g of beeswax.

Formulation 5

A solid cleaner was made by combining 34 g of stock solution #1 with 33 g of glycerin and 33 g of carnauba wax.

Formulation 6

A solid cleaner was made by combining 34 g of stock solution #1 with 40 g of glycerin and 26 g of carnauba wax.

Formulation 7

A solid cleaner was made by combining 34 g of stock solution #1 with 40 g of glycerin and 26 g of candelilla wax.

Formulation 8

A solid cleaner was made by combining 34 g of stock solution #2 with 40 g of glycerin and 26 g of candelilla wax.

Formulation 9

A solid cleaner was made by combining 34 g of stock solution #2 with 40 g of glycerin and 26 g of candelilla wax impregnated into a pad.

Formulation 10

A solid cleaner was made by combining 34 g of stock solution #2 with 40 g of glycerin and 26 g of beeswax impregnated into a pad.

Formulation 11

A solid cleaner was made by combining 34 g of stock solution #2 with 40 g of glycerin and 26 g of carnauba wax impregnated into a pad.

Formulation 12

A solid cleaner was made by combining 34 g of stock solution #2 with 40 g of glycerin and 26 g of lemon peel wax.

Formulation 13

A solid cleaner was made by combining 24 g of stock solution #2 with 40 g of glycerin and 26 g of carnauba wax and 10 g of sodium bicarbonate.

Formulation 14

A solid cleaner was made by combining 24 g of stock solution #2 with 40 g of glycerin and 26 g of carnauba wax and 10 g of sodium metasilicate.

Formulation 15

A solid cleaner was made by combining 34 g of stock solution #2 with 40 g of glycerin and 26 g of rice wax.

Formulation 16

A solid cleaner was made by combining 34 g of stock solution #2 with 40 g of glycerin and 26 g of orange peel wax.

Results

Experimental samples were compared against Scotch-Brite™ Quick Clean Griddle Liquid No. 700 (Quick Clean or 700) (3M Company, St. Paul, Minn.) and rated for melting time (in seconds), and cleaning performance. A visual rating was given for cleaning performance. The rating scale went from 1 to 5, with 5 being no food residue left on the heated surface. The temperature of the griddle was recorded with an IR thermometer.

A comparison of the performance of the different experimental formulations against Quick Clean is shown in the table below.

Griddle Cleaner Evaluation

| Example | Formulation | Soil | Griddle Temperature (° F.) | Melting Time (sec) | Cleaning Performance |
|---|---|---|---|---|---|
| 1 | 1 | Oil | | | 3 |
| 2 | 2 | Oil | | | 3 |
| 3 | 3 | Oil | | | 3 |
| 4 | 4 | Oil | 330 | 38 | 3 |
| 5 | 5 | Oil | 325 | 45 | 3 |
| 6 | 6 | Oil | 300 | 42 | 3 |
| 7 | Quick Clean | Oil | 330 | N/A | 5 |
| 8 | 7 | Oil | 330 | 40 | 3 |
| 9 | 8 | Oil | 325 | 42 | 5 |
| 10 | 9 | Oil | 330 | | 5 |
| 11 | 9 | Oil | 325 | 110 | 5 |
| 12 | 10 | Oil | 335 | 40 | 5 |
| 13 | 11 | Oil | 325 | 30 | 3 |
| 14 | 8 | Beef | 350 | 85 | 5 |
| 15 | 8 | Beef | 350 | 120 | 5 |
| 16 | 8 | Beef | 360 | 19 | 5 |
| 17 | 8 | Beef | 360 | 67 | 5 |
| 18 | Quick Clean | Beef | 340 | N/A | 5 |
| 19 | 11 | Oil | 350 | 45 | 5 |
| 20 | 12 | Oil | 340 | 54 | 5 |
| 21 | 15 | Oil | 330 | 38 | 5 |
| 22 | 16 | Oil | 325 | 32 | 3 |

Further Prepared and Tested Samples:

The following formulations were made up using Quick Clean, FAME, PEG 1000, 4600 and 8000 as well as Stock Solutions #1 and #3.

| Compositions in % wt | | | | | | |
|---|---|---|---|---|---|---|
| Example # | | PEG | | | Stock Solution | |
| Quick Clean (1) | FAME | 1000 | 4600 | 8000 | #1 | #3 |
| 23 | 16 | | 50 | | | 34 |
| 24 | 16 | | | 50 | | 34 |
| 25 | 36 | 30 | | | | 34 |

-continued

| Compositions in % wt | | | | | | |
|---|---|---|---|---|---|---|
| Example # | | PEG | | | Stock Solution | |
| Quick Clean (1) | FAME | 1000 | 4600 | 8000 | #1 | #3 |
| 26 | 36 | | | | | 34 |
| 27 | 36 | | 30 | 60 | | 34 |
| 28 | 50 | 16 | | | | 34 |
| 29 | 50 | | 16 | | 34 | |
| 30 | 50 | | 16 | | | 34 |
| 31 | 50 | | | 16 | | 34 |

The following formulations were made up using Glycerin, Tone Polyols (210, 230, 240 and 260), Stock Solution #3. In addition, Example #42 and #43 were loaded into a Scotch-Brite™ Griddle Polishing Pad No. 46.

| Composition in % wt | | | | | | | | |
|---|---|---|---|---|---|---|---|---|
| Example | | Difunctional Tone Polyol | | | | Stock solution | | Loaded |
| # | Glycerin | 210 | 230 | 240 | 260 | #1 | #3 | Pad |
| 32 | 13 | 69 | | | | | 18 | NO |
| 33 | 13 | | 69 | | | | 18 | NO |
| 34 | 13 | | | | | | 18 | NO |
| 35 | 13 | | | | 69 | | 18 | NO |
| 36 | 13 | 69 | | | | | 18 | YES |
| 37 | 13 | | | | 69 | | 18 | YES |

The following formulations were made up using Glycerin, Tone Polyols (210 and 260), SPAN 40, SPAN 65, Quick Clean and Stock Solutions #3 and #4.

| Composition in % wt | | | | | | | | |
|---|---|---|---|---|---|---|---|---|
| Example | Glyc- | Difunctional Tone Polyol | | Surfactant SPAN | SPAN | Quick | Stock Solution | |
| # | erin | 210 | 260 | 40 | 65 | Clean | #3 | #4 |
| 38 | 13 | | 61 | 10 | | | 16 | |
| 39 | 13 | | 61 | | 10 | | 16 | |
| 40 | | | 77 | | | 23 | | |
| 41 | 13 | 41 | 33 | | | | 13 | |
| 42 | 13 | 67 | | | | | | 20 |
| 43 | 13 | | 68 | | | | | 19 |

The following formulations were made up using Glycerin, Tone Polyols (210 and 260), SPAN 40, Brij 35, Pluracare L44 NF, BioSoft D-40, PEG 1000, and Stock Solution #3.

| Composition in % wt | | | | | | | | | |
|---|---|---|---|---|---|---|---|---|---|
| | | | | Surfactants/Detergents | | | | | |
| Example | | Difunctional Tone Polyol | | | Brij | Pluracare L44 | BioSoft | PEG | Stock Sol. |
| # | Glycerin | 210 | 260 | Span 40 | 35 | NF | D-40 | 1000 | #3 |
| 44 | 14 | 68 | | | 0.05 | | | | 18 |
| 45 | 14 | 68 | | | | | 0.2 | | 18 |

-continued

| Composition in % wt | | | | | | | | | |
|---|---|---|---|---|---|---|---|---|---|
| | | | | Surfactants/Detergents | | | | | |
| Example | | Difunctional Tone Polyol | | | Brij | Pluracare L44 | BioSoft | PEG | Stock Sol. |
| # | Glycerin | 210 | 260 | Span 40 | 35 | NF | D-40 | 1000 | #3 |
| 46 | 13 | 69 | | | | 0.05 | | | 17 |
| 47 | 14 | 58 | | | | | | 10 | 16 |
| 48 | 11 | | 66 | | | | | 8 | 14 |
| 49 | 14 | 67 | | 1 | | | | | 18 |
| 50 | 14 | | 67 | 1 | | | | | 18 |

The following formulations were made up using Quick Clean, Glycerin, Tone Polyols (210 and 260), SPAN 40, EDTA, and Stock Solution #2.

| Composition in % wt | | | | | | |
|---|---|---|---|---|---|---|
| Example | | Difunctional Tone Polyol | | Surfactant | Sequester | Stock Sol. |
| # | Glycerin | 210 | 260 | SPAN 40 | EDTA | #3 |
| 51 | 14 | | 66 | | 3 | 17 |
| 52 | 14 | 67 | | 0.05 | 3 | 17 |
| 53 | 13 | 71 | | 0.05 | 1 | 15 |

| Example # | Stock Solution #2 (g) | Glycerin (g) | Candelilla Wax (g) | Xanthan Gum (g) |
|---|---|---|---|---|
| 54 | 42.7 | 41.0 | 16.3 | 0.0 |
| 55 | 42.2 | 40.4 | 16.1 | 1.2 |
| 56 | 40.2 | 38.5 | 15.4 | 5.9 |
| 57 | 39.3 | 37.6 | 15.0 | 8.1 |
| 58 | 50.0 | 29.4 | 19.1 | 1.5 |
| 59 | 47.2 | 27.8 | 18.1 | 6.9 |
| Formulation 9 | 34.0 | 40.0 | 26.0 | 0.0 |

Performance of these examples were compared to the control sample Formulation 9 (solid cleaner with no xanthan gum). Formulations were rated for cleaning performance. A visual rating was given for each of these qualitative attributes listed above. The rating scale went from 1 to 5, with 5 being best.

| Example # | Stock Solution #2 (g) | Glycerin (g) | Candelilla Wax (g) | Xanthan Gum (g) | ratio Gly/Wax | Melting time (sec) | Cleaning performance |
|---|---|---|---|---|---|---|---|
| 54 | 42.7 | 41.0 | 16.3 | 0.0 | 2.5 | 45 | 5 |
| 55 | 42.2 | 40.4 | 16.1 | 1.2 | 2.5 | 50 | 5 |
| 56 | 40.2 | 38.5 | 15.4 | 5.9 | 2.5 | 40 | 5 |
| 57 | 39.3 | 37.6 | 15.0 | 8.1 | 2.5 | 40 | 1 |
| 58 | 50.0 | 29.4 | 19.1 | 1.5 | 1.5 | 38 | 4 |
| 59 | 47.2 | 27.8 | 18.1 | 6.9 | 1.5 | 36 | 1 |
| Formulation 9 | 34.0 | 40.0 | 26.0 | 0.0 | 1.5 | 45 | 5 |

The following griddle cleaner formulations were made using Stock Solution #2, Glycerin, Candelilla Wax, and Xanthan Gum. The stock solution and glycerin were added to a beaker and placed on a hot plate/stirrer. The solution was heated to about 100° C. while gently mixing. The wax was added to the stock solution/glycerin mix and left in the heat while stirring until the wax was completely melted. Xanthan gum was added to the formulations at 100° C. after the wax was melted. The formulation was taken off the heat once it was well mixed and homogeneous.

Tablets and impregnated pads were made by either pouring into the molds to form tablets or pads. Tablets were made by allowing the melted formulation to cool down to room temperature in an aluminum mold of 2"×2"×1" (W×L×H). Tablets of 50 g each were made with this mold. Impregnated pads (#46) were also made by pouring the melted formulation on a mold of 4"×5.5"×1" (W×L×H) at about 80° C., allowing it to cool down to about 60° C. and then placing the pad and applying a little pressure. Pads of 100 g each were allowed to cool to room temperature.

Results appear to indicate that formulations containing xanthan gum up to 6% were solid even when the amount of candelilla wax was significantly reduced from 26 g to 15-16 g. Examples 55 and 56 appear to show performance comparable to that of the control sample Formulation 9 (formulation with no thickener and higher wax content).

A variety of abrasive materials were added to Formulation 9 to form the Examples listed in the table below. The examples including abrasive materials were loaded onto the non-abrasive #9488R pad, while the Formulation 9 and the quick clean example was loaded onto an abrasive #46 pad. Tablets and impregnated pads were made by either pouring into the molds to form tablets or pads. Tablets were made by allowing the melted formulation to cool down to room temperature in an aluminum mold of 2"×2"×1" (W×L×H). Tablets of 50 g each were made with this mold. Impregnated pads were also made by pouring the melted formulation on a mold of 4"×5.5"×1" (W×L×H) at about 80° C., allowing it to cool down to about 60° C. and then placing the pad and applying a little pressure. Pads of 100 g each were allowed to cool to room temperature.

Performance of these examples were compared to the control sample Formulation 9 (solid cleaner with no abrasive) and to Quick Clean. Formulations were rated for cleaning performance. A visual rating was given for each of these qualitative attributes listed above. The rating scale went from 1 to 5, with 5 being best.

| Example # | Abrasive | Grams of Abrasive/ 100 g of Wax | Soil | Cleaning performance |
|---|---|---|---|---|
| 60 | Sodium Bicarbonate | 10 | Oil | 1 |
| 61 | Sodium Bicarbonate | 20 | Oil | 5 |
| 62 | Sodium Metasilicate | 10 | Oil | 1 |
| 63 | Sodium Metasilicate | 20 | Oil | 1 |
| 64 | Pumice 0 | 10 | Oil | 3 |
| 65 | Pumice 0 | 20 | Oil | 4 |
| 66 | Pumice 0 | 30 | Oil | 1 |
| 67 | Pumice 0 | 50 | Oil | 1 |
| 68 | Pumice FF | 10 | Oil | 3 |
| 69 | Pumice FF | 20 | Oil | 4 |
| 70 | Pumice 0 | 10 | Beef | 5 |
| 71 | Pumice FF | 10 | Beef | 5 |
| 72 | Melamine Resin | 10 | Oil | 5 |
| 73 | Melamine Resin | 20 | Oil | 5 |
| 74 | Melamine Resin | 30 | Oil | 5 |

-continued

| Example # | Abrasive | Grams of Abrasive/ 100 g of Wax | Soil | Cleaning performance |
|---|---|---|---|---|
| Formulation 9 | — | — | Oil | 5 |
| Quick Clean | — | — | Oil | 5 |
| Formulation 9 | — | — | Beef | 5 |
| Quick Clean | — | — | Beef | 5 |

These results appear to indicate that the performance of abrasive containing formulations was the same or better than the Quick Clean and control sample Formulation 9.

Emulsifying Wax NF was added to Formulation 9 to form the Examples listed in the table below. Tablets and impregnated pads were made by either pouring into the molds to form tablets or pads. Tablets were made by allowing the melted formulation to cool down to room temperature in an aluminum mold of 2"×2"×1" (W×L×H). Tablets of 50 g each were made with this mold. Impregnated pads (#46) were also made by pouring the melted formulation on a mold of 4"×5.5"×1" (W×L×H) at about 80° C., allowing it to cool down to about 60° C. and then placing the pad and applying a little pressure. Pads of 100 g each were allowed to cool to room temperature.

Performance of these examples were compared to the control sample Formulation 9 (solid cleaner with no emulsifying wax). Formulations were rated for cleaning performance. A visual rating was given for each of these qualitative attributes listed above. The rating scale went from 1 to 5, with 5 being best.

| Example # | Stock Solution #2 (g) | Glycerin (g) | Candelilla Wax (g) | Emulsifying Wax NF (g) | ratio Cand/Emul | Melting time (sec) | Cleaning performance |
|---|---|---|---|---|---|---|---|
| 75 | 34 | 40 | 13 | 13 | 1:1 | 25 | 5 |
| 76 | 34 | 40 | 9 | 17 | 1:2 | 30 | 5 |
| 77 | 34 | 40 | 17 | 9 | 2:1 | 30 | 5 |
| 78 | 34 | 40 | 20 | 6 | 3:1 | 35 | 5 |
| Formulation 9 | 34 | 40 | 26 | 0 | 0 | 45 | 5 |
| 79 | 34 | 30 | 13 | 13 | 1:1 | 30 | 5 |
| 80 | 34 | 25 | 13 | 13 | 1:1 | 25 | 5 |
| 81 | 34 | 20 | 13 | 13 | 1:1 | 25 | 5 |

These results appear to indicate that formulations that contain Emulsifying Wax NF melt faster than the control sample formulation 9. In addition, formulations that contain Emulsifying Wax NF were reported to have less "drag" when applied to the heated surface than the control sample formulation 9.

The following formulations were made up using stock solution #2, glycerin, wax and an emulsifying wax (cetyl and/or stearyl alcohol).

| Example # | Stock Solution #2 (g) | Glycerin (g) | Candelilla Wax (g) | Carnauba Wax (g) | Cetyl Alcohol (g) | Stearyl Alcohol (g) | Melting time (sec) | Cleaning performance |
|---|---|---|---|---|---|---|---|---|
| 82 | 34 | 40 | 13 | 0 | 0 | 13 | 38 | 5 |
| 83 | 34 | 40 | 13 | 0 | 13 | 0 | 35 | 5 |
| 84 | 34 | 40 | 13 | 0 | 6.5 | 6.5 | 38 | 5 |
| 85 | 34 | 40 | 0 | 13 | 0 | 13 | 48 | 5 |
| 86 | 34 | 30 | 0 | 13 | 0 | 13 | 33 | 5 |

All references and publications cited herein are expressly incorporated herein by reference in their entirety into this disclosure. Illustrative embodiments of this disclosure are discussed and reference has been made to possible variations within the scope of this disclosure. These and other variations and modifications in the disclosure will be apparent to those skilled in the art without departing from the scope of this disclosure, and it should be understood that this disclosure is not limited to the illustrative embodiments set forth herein. Accordingly, the disclosure is to be limited only by the claims provided below.

What is claimed is:

1. A solid cleaner for heated surfaces comprising:

glycerin;

a solidifying agent comprising wax, the wax being from 25 to 75 wt % of the solid cleaner; and a cleaning agent comprising a carbonate salt and water or silicate salt and water;

wherein, the solid cleaner is solid at room temperature and liquid at an elevated temperature.

2. A solid cleaner according to claim 1, wherein the solid cleaner has a melting point in a range from 45 to 90 degrees Celsius.

3. A solid cleaner according to claim 2, wherein the wax is insoluble in water.

4. A solid cleaner according to claim 1, wherein the solidifying agent comprises a natural wax selected from the group consisting of beeswax, candelilla wax, carnauba wax, rice bran wax, lemon peel wax, soy wax, orange peel wax and mixtures thereof, a polyol, a polyethylene glycol, or a poly (ε-caprolactone).

5. A solid cleaner according to claim 1, wherein the cleaning agent comprises a surfactant.

6. A solid cleaner according to claim 1, further comprising an abrasive material.

7. A solid cleaner according to claim 1, further comprising a thickener.

8. A solid cleaner according to claim 1, further comprising an emulsifying wax.

9. A solid cleaner according to claim 1, further comprising a wax including a fatty alcohol, a stearic alcohol, a cetyl alcohol, or mixtures thereof.

10. A solid cleaner according to claim 1, wherein the solid cleaner comprises natural wax, glycerin, carbonate salt, water, and an emulsifying wax.

11. A method of cleaning a heated surface comprising steps of:

contacting a heated surface comprising cooking residue with a solid cleaner comprising:

glycerin;

a solidifying agent comprising wax, the wax being from 25 to 75 wt % of the solid cleaner; and a cleaning agent comprising a carbonate salt and water or silicate salt and water;

wherein, the solid cleaner is solid at room temperature and liquid at an elevated temperature;

melting the solid cleaner on the heated surface;

contacting the cooking residue with the melted solid cleaner; and removing at least a portion of the cooking residue from the heated surface.

12. A method according to claim 11, wherein the contacting a heated surface step comprises contacting a food preparation surface heated to a temperature of at least 100 degrees Celsius with a solid cleaner according to claim 1.

13. A cleaning article comprising;

a substrate; and a solid cleaner, comprising:

glycerin;

a solidifying agent comprising wax, the wax being from 25 to 75 wt % of the solid cleaner; and a cleaning agent comprising a carbonate salt and water or silicate salt and water;

wherein, the solid cleaner is solid at room temperature and liquid at an elevated temperature;

the solid cleaner being disposed on or within the substrate.

14. A cleaning article according to claim 13, wherein the solid cleaner comprises a solid cleaner layer disposed on the substrate.

15. A cleaning article according to claim 13, wherein the solid cleaner comprises a solid cleaner disposed within the substrate.

16. A cleaning article according to claim 13, wherein the substrate comprises a woven web of fibers.

17. A cleaning article according to claim 13, wherein the substrate comprises a woven web of fibers and further comprises inorganic or organic abrasive particles bonded to the woven web of fibers.

18. A cleaning article according to claim 13, wherein the substrate comprises a three-dimensional non-woven web of fibers bonded to one another at points of mutual contact.

19. A cleaning article according to claim 13, wherein the substrate comprises a three-dimensional non-woven web of fibers bonded to one another at points of mutual contact and further comprises inorganic abrasive particles bonded to the non-woven web of fibers.

20. A cleaning article according to claim 13, wherein the substrate comprises a three-dimensional non-woven web of fibers bonded to one another at points of mutual contact and further comprises organic abrasive particles bonded to the non-woven web of fibers.

* * * * *

UNITED STATES PATENT AND TRADEMARK OFFICE

CERTIFICATE OF CORRECTION

PATENT NO. : 7,915,211 B2
APPLICATION NO. : 11/816315
DATED : March 29, 2011
INVENTOR(S) : Lowell Caryl Zeller et al.

It is certified that error appears in the above-identified patent and that said Letters Patent is hereby corrected as shown below:

In the Specification

Column 3
Line 23, Delete "shape," and insert -- shape. --, therefor.
Line 59, Delete "Baker-Hugnes" and insert -- Baker-Hughes --, therefor.

Column 9
Line 45, Delete "Uniquema" and insert -- Uniqema --, therefor.
Line 48, Delete "Lundwigshafen" and insert -- Ludwigshafen --, therefor.
Line 51, Delete "Sequesterant" and insert -- Sequestrant --, therefor.

Column 11
Line 10, After "towel" insert -- . --.
Line 14, After "griddle" insert -- . --.
Line 20, After "minutes" insert -- . --.
Line 34, After "squeegee" insert -- . --.

In the Claims

Column 19
Line 28, In Claim 4, delete "carnauba" and insert -- camauba --, therefor.

Signed and Sealed this
Twelfth Day of November, 2013

Teresa Stanek Rea
*Deputy Director of the United States Patent and Trademark Office*